United States Patent [19]

Deardorff

[11] Patent Number: 4,844,295

[45] Date of Patent: Jul. 4, 1989

[54] TABLET DISPENSER

[76] Inventor: Tim Deardorff, P.O. Box 552, Wenatchee, Wash. 98801

[21] Appl. No.: 180,907

[22] Filed: Apr. 13, 1988

[51] Int. Cl.[4] ..... B65D 83/04

[52] U.S. Cl. ..... 221/263; 206/531; 221/265; 221/288

[58] Field of Search ..... 206/531, 534; 221/263, 221/264, 265, 266, 235, 288

[56] References Cited

U.S. PATENT DOCUMENTS

| | | | |
|---|---|---|---|
| 1,600,158 | 9/1926 | Williams | 221/264 |
| 2,204,821 | 6/1940 | Priddy | 221/263 |
| 2,475,738 | 7/1949 | Epplin | 221/264 |
| 3,245,389 | 4/1966 | Temliak | 221/265 |
| 3,467,277 | 9/1969 | Tolliver | 221/264 |
| 3,759,420 | 9/1973 | Karkanen | 221/288 |
| 3,860,111 | 1/1975 | Thompson | 221/265 X |
| 3,866,797 | 2/1975 | Palomo | 221/263 |

FOREIGN PATENT DOCUMENTS

| | | | |
|---|---|---|---|
| 2045977 | 3/1972 | Fed. Rep. of Germany | 221/265 |

*Primary Examiner*—Duane A. Reger
*Assistant Examiner*—Matthew C. Graham
*Attorney, Agent, or Firm*—Leon Gilden

[57] ABSTRACT

A tablet dispenser is set forth comprising a cap to "snap on" an associated tablet container wherein said cap includes a spring-biased plunger positioned normally in a retracted position communicating with a conduit aligned with the plunger wherein an opening directed orthogonally to said conduit permits passage of tablets upon inverting an associated tablet container and subsequent displacement of said tablet through said conduit by manual manipulation of said plunger. A modification provides a two-part cap wherein an upper part is rotatable relative to a lower part wherein said lower part is engageable with an associated tablet dispenser preventing undesirable withdrawal of tablets from said dispenser until alignment of the upper part of the cap with the lower part to align a two-part opening with an associated conduit wherein a spring-biased connection between the upper and lower parts of the cap maintain the two parts of the cap in a predetermined orientation relative to one another.

2 Claims, 3 Drawing Sheets

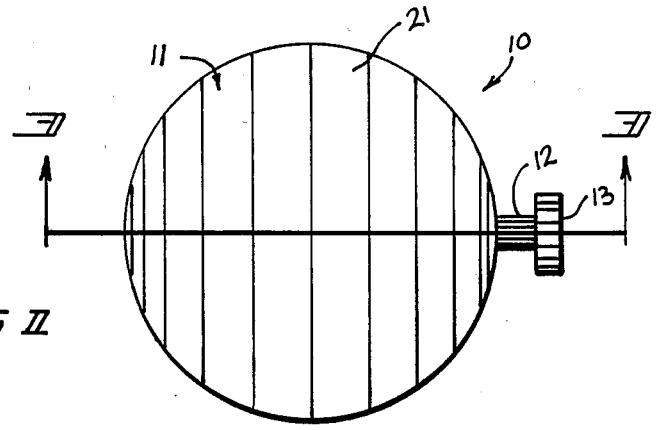
FIG. 1
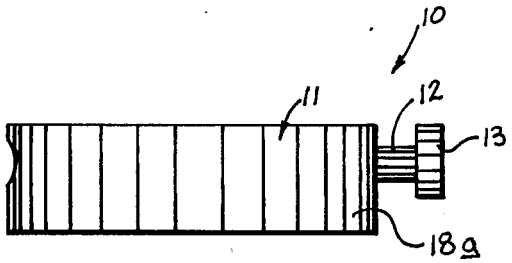
FIG. 2
FIG. 3
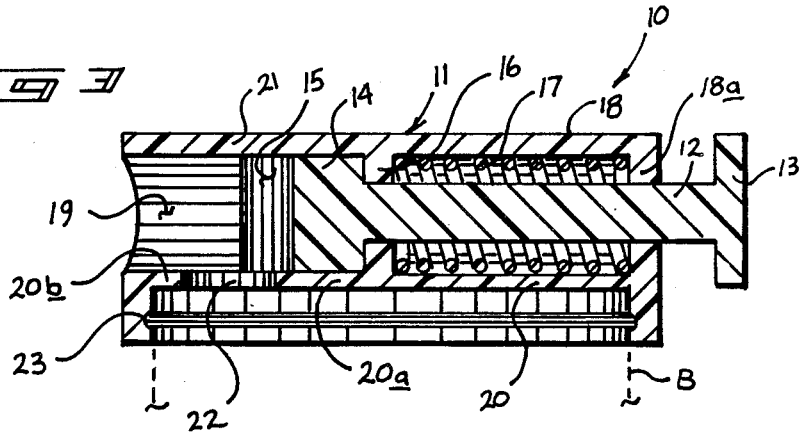

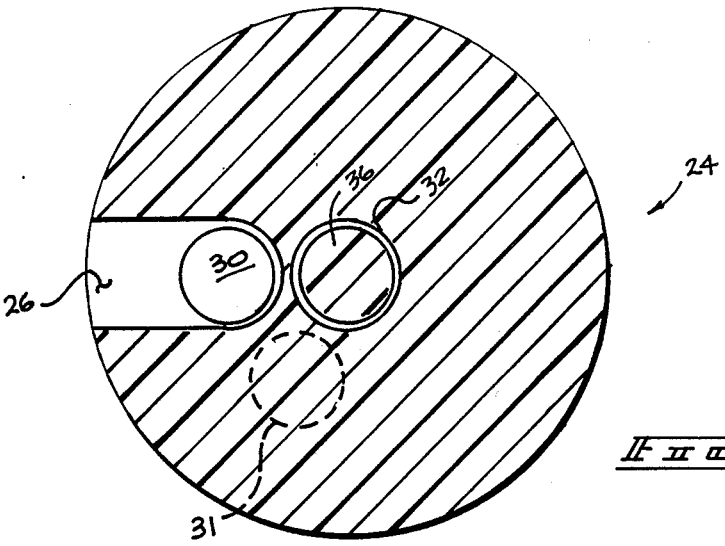
FIG 5
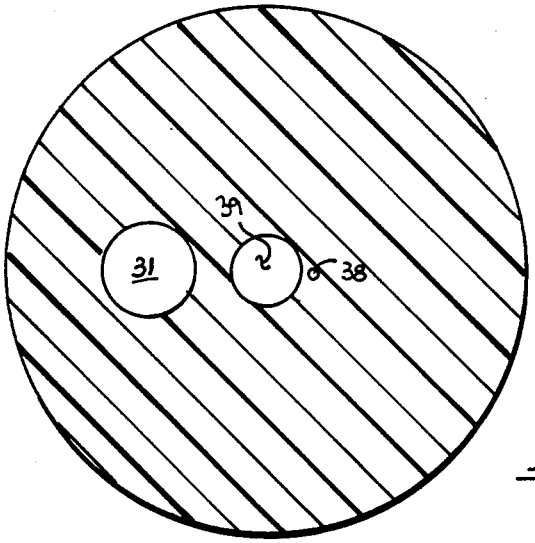
FIG 6
FIG 7
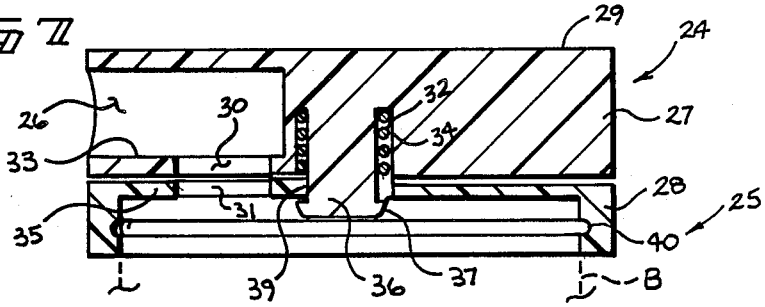

TABLET DISPENSER

BACKGROUND OF THE INVENTION

1. Field of the Invention

The field of invention relates to tablet dispensers and particularly pertains to a new and improved tablet dispenser providing in a first mode a spring-biased plunger directing with integrally directed opening into an associated tablet container to accept a tablet therefrom and project said tablet through a cooperating conduit within said cap outwardly of said cap with a second mode of invention utilizing a two-part cap to effectively and efficiently prevent undesirable removal of tablets from said cap.

2. Description of the Prior Art

The use of tablet dispensing caps is well known in the prior art. As may be appreciated, these devices are typically of relatively complex and of expansive construction in hinder their efficient utilization by a user thereof. In this connection, there have been several attempts to develop tablet dispensing caps which may be easily and efficiently utilized when desired. For example, U.S. Pat. No. 3,279,651 to Thompson utilizes a multipart cap wherein a lower part secures individual tablets secured within a rupture pack whereupon relative motion of a lower part of the cap relative to an upper part, and associated cam directs a tablet secured within the lower part upwardly and simultaneously ruptures a cell containing the tablet to project the tablet outwardly of the cap organization. While an effective means of delivering individual tablets from individually cells, the Thompson patent fails to provide a cap easily interfitting with an associated container to house a magazine of tablets for selective dispensing through associated conduits.

U.S. Pat. No. 3,365,099 to McTaggart sets forth a tablet dispenser wherein an overlying single row of tablet are stacked one upon the other within an extending magazine where an underlying plunger individually directs tablets from the dispenser housing. The McTaggart patent is of relative interest with regard to a plunger directed tablet dispenser, but fails to provide an easily snap-fit cap for use with bulk containers housing a random array of tablets therein.

U.S. Pat. No. 3,651,927 to Richardson sets forth a circular housing including an array of individually sealed tablets about an inner perimeter thereof wherein an axially pivotal plunger oriented axially of the flip-up housing projects an individual tablet through an underlying port of a series of ports through said housing such that the plunger may be rotated to sequentially remove and eject such tablets from the housing. While the Richardson patent is of interest relative to a plunger actuated tablet dispenser, the structure and intent of the apparatus is relatively remote to that of the instant invention.

U.S. Pat. No. 3,904,075 to Richardson sets forth an improvement over the aforenoted Richardson patent wherein an overlying housing encloses a perimeter of individually sealed tablets within a relatively rotatable underlying housing such that the overlying housing is of a flexible nature to permit plunging of a portion overlying the individual tablets to permit ejection of the tablets through a lower part of the circular housing to enable a user, as opposed to aforenoted Richardson patent, to selectively eject tablets without recourse to opening the housing.

U.S. Pat. No. 4,074,806 to Ardito sets forth a housing generally shaped as a rectangular parallel piped wherein a plurality of positionable manually operable conveyor means incrementally sequences a plurality of tablets along either side of the container to enable ejection of the tablets through respective openings at forwardmost portions by means of a levering plunger formed integrally with the upper part of the housing.

As such it may be appreciated that there is a continuing need for a new and improved tablet dispenser which addresses both the problem of ease of use and effectiveness and in this respect, the present invention substantially fulfills this need.

SUMMARY OF THE INVENTION

In view of the foregoing disadvantages inherent in the known types of tablet dispensers now present in the prior art, the present invention provides an tablet dispenser wherein a tablet dispenser of a snap-on interfitting relationship with an underlying magazine container enables effective and efficient withdrawal of tablets therefrom, as desired, and may be further easily and efficiently transported with the container during periods of non-use. As such, the general purpose of the present invention, which will be described subsequently in greater detail, is to provide a new and improved tablet dispenser which has all the advantages of the prior art tablet dispensers and none of the disadvantages.

To attain this, the present invention comprises a one-piece cap in a first mode that is formed with an angular groove for frictional interfitting with a lip of an associated container. A spring-loaded plunger is maintained in a normally retracted position and is oriented relative to an opening in communication with the container to accept a tablet when said container is inverted and position a tablet proximate a forward face of the plunger whereupon the plunger may drive a tablet orthogonally relative to an axis of the cap through a conduit orthogonally oriented to an opening in communication with the container. In a second mode, a two-part cap is utilized with a biasing means interfitting between the two parts to maintain the two-part cap in a predetermined orientation relative to one another whereupon an opening in an upper part of the cap is rotatably communicatable with a lower opening in a stationary or lower part of the cap to accept a tablet and enable delivering of said tablet through an orthogonally oriented communicating conduit by manually manipulation the container and associated cap.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foreging abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tablet dispenser which has all the advantages of the prior art tablet dispensers and none of the disadvantages.

It is another object of the present invention to provide a new and improved tablet dispenser which may be easily and efficiently manufactured and marketed.

It is a further object of the present invention to provide a new and improved tablet dispenser which is of a durable and reliable construction.

An even further object of the present invention is to provide a new and improved tablet dispenser which is susceptible of a low cost of manufacture with regard to both materials and labor, and which accordingly is then susceptible of low prices of sale to the consuming public, thereby making such tablet dispensers economically available to the buying public.

Still yet another object of the present invention is to provide a new and improved tablet dispenser which provides in the apparatuses and methods of the prior art some of the advantages thereof, while simultaneously overcoming some of the disadvantages normally associated therewith.

Still another object of the present invention is to provide a new and improved tablet dispenser wherein a spring-loaded plunger accepts a tablet from an associate bottle to deliver same through an orthogonally communicating conduit operative of said opening.

Yet another object of the present invention is to provide a new and improved tablet dispenser wherein a two-part relatively rotatable cap is formed with an upper part formed with a conduit and an orthogonally oriented opening rotatably communicating with an opening in a lower portion of the cap to accept a tablet upon alignment of the openings in respective parts of the cap and enable delivering of a tablet outwardly of the cap by manual manipulation of the cap and associated container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of the instant invention.

FIG. 3 is an orthographic view taken along the lines 3—3 of FIG. 1 in the direction indicated by the arrows.

FIG. 4 is isometric illustration of a modification of the instant invention.

FIG. 5 is an orthographic top view of the invention as depicted in FIG. 4, along the lines 5—5 in the direction indicated by the arrows.

FIG. 6 is an orthographic top view of the instant invention as that depicted in FIG. 4 along the lines 6—6 in the direction indicated by the arrows.

FIG. 7 is an orthographic view of the invention as depicted in FIG. 4 taken along the lines 7—7 in the direction indicated by the arrows.

DESCRIPTION OF THE PREFERRED EMBODIMENT

Figure 2:
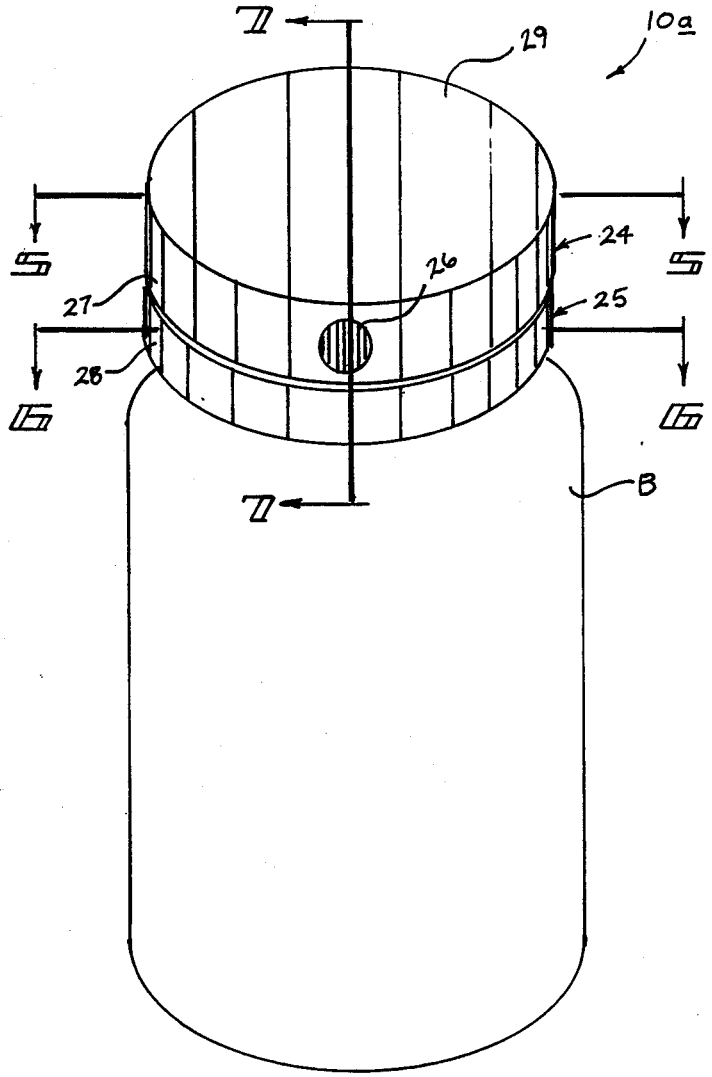
FIG. 2 is an orthographic view taken in elevation of the instant invention.

With reference now to the drawings, and in particular to FIGS. 1 to 7 thereof, a new and improved tablet dispenser embodying the principles and concepts of the present invention and generally designated by the reference numerals 10 and **10*a*** will be described.

More specifically, it will be noted that the tablet dispenser apparatus 10 essentially comprises a cap 11 for interfitting with a tablet containing bottle "B", as illustrated in FIG. 3, including a plunger 12 of a first diameter integrally formed with a pressure pad 13 of a second diameter and a head 14 of an equal second diameter. Said head 14 is formed with a curvilinear convex face 15 of a radius of curvature equal to an associated conduit 19 wherein head 14 slidably reciprocates. Conduit 19 is bounded medially of cap 11 by interior wall 16 dividing conduit 19 and a spring chamber 18 wherein spring chamber 18 is bounded at its other end by exterior wall **18*a* of cap 11**.

A floor 20 is positioned orthogonally to wall **18*a* and projects interiorly thereof below the height defined by the diameter of conduit 19 and defines a floor therethrough the interior of cap 11 with a communicating opening 22 directed to cooperate with the interior of bottle "B" and thereby defining a first ledge 20*a* upon which head 14 is captured and a second ledge 20*b*, as illustrated in FIG. 3**.

Formed interiorly of exterior wall **18*a* of cap 11 below the aforenoted floor 20 is an endless annular groove formed generally parallel to the floor 20, top surface wall 21 and orthogonal to the exterior wall 18*a***.

In use, it may be readily understood that an associated bottle "B" interfitting with the tablet dispenser 10 is merely inverted from the position, as illustrated in FIG. 3, whereupon a tablet will be directed through opening 22 positioned proximate the curvilinear convex face 15 of plunger 12 and by merely manually pressing on the pad 13 by a user, a tablet will be forced outwardly of the cap 11 through conduit 19.

With attention to FIG. 4, a modified embodiment of the instant invention is set forth wherein a two-part tablet dispenser **10*a* is formed of a top cap portion 24 rotatably associated with a stationary underlying bottom cap portion 25 with a tablet directing conduit 26 formed in the top cap portion 24 orthogonally to the upper side wall of top cap portion 24**.

As illustrated in FIG. 7, the upper cap portion 24 is bounded by an upper cap top surface 29 to thereby define the conduit 26 formed radially therethrough orthogonal to an axis of rotation of caps 24 and 25. An upper opening 30 is formed in the floor 33 of top cap portion 24, as illustrated in FIGS. 5 and 7, to cooperate with a lower opening 31 formed in the groove 35 of lower cap portion 25 in selective alignment, as illustrated in FIG. 7.

An annular spring chamber 32 is formed within the upper cap portion 25 axially thereof with a downwardly depending connecting boss 36 of a length extending beyond the end of a spring chamber 32 and beyond the roof of bottom cap portion 25 with a radially outwardly extending flange 37 wherein a plug 38 positioned within a lower port 39 formed in groove 35 captures the plug 38 and secures the top cap portion and bottom cap portion together, as illustrated in FIG. 7. Furthermore, a positioning spring 34 is also captured within the spring chamber 32 by use of the plug 38 which furthermore enhances the ease of assembly and manufacture of the instant invention.

A lower annular groove 40 comparable to the groove 23 of the tablet dispenser of FIGS. 1 to 3 secures a bottle "B" formed with a companion rib formed thereon, as illustrated in FIG. 7.

By virtue of the positioning spring 34 the top cap portion 24 maintains a preset position relative to bottle cap portion 25 whereupon in use the apparatus as set forth in FIG. 7 is merely inverted whereupon by alignment of upper opening 30 with lower opening 31 by rotation of top cap portion 24, a tablet may be directed through the aligned openings and positioned within conduit 26 whereupon mere repositioning of the caps to misalign the respective lower and upper openings 31 and 30, as illustrated in FIG. 5, a tablet may then be dispensed through the associated conduit 26 for ultimate use.

As to the manner of usage and operation of instant invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tablet dispenser apparatus for use with a reservoir bottle containing a plurality of tablets and formed with a circumferential flange at its upper end, said apparatus comprising a cylindrical cap means formed with a top surface, an annular side wall surface, and a floor orthogonally positioned above a lower terminal edge of said side wall surface to define lower chamber, and an annular groove formed in an interior surface of said annular side wall surface for frictional interfitting engagement with said circumferential flange, and a conduit formed orthogonally through said annular side wall surface between said floor and said top surface a distance less than the radius of said cylindrical cap means to cooperate with an opening in said floor, and a biased plunger means positioned in alignment with said conduit of a length greater than the radius of said cap means for directing a tablet accepted through said opening and outwardly of said conduit means, and said plunger including a spring chamber positioned between said annular side wall surface and an interior wall of said cap means wherein a plunger head is in abutment with said interior wall on an opposite side relative to said spring chamber when said plunger is in a retracted position, and wherein said plunger head further includes a convex tablet displacement surface means in an aligned relationship to said conduit to direct a tablet outwardly of said cap means when said plunger is in an extended position.

2. A tablet dispenser apparatus as set forth in claim 1 wherein said plunger includes a rod of a first diameter directed through said spring chamber wherein said rod is positioned centrally of a spring positioned within said spring chamber and captured between said interior wall and an interior surface of said annular side wall wherein said plunger includes a pressure pad of a second diameter equal to a diameter of said plunger head.

* * * * *